US006706650B2

(12) United States Patent
Gibson et al.

(10) Patent No.: US 6,706,650 B2
(45) Date of Patent: Mar. 16, 2004

(54) FLAME-RESISTANT AND HIGH VISIBILITY FABRIC AND APPAREL FORMED THEREFROM

(75) Inventors: Richard M. Gibson, Weaverville, NC (US); Willis D. Campbell, Jr., Summerfield, NC (US); Albert E. Johnson, Burlington, NC (US); Kenneth P. Wallace, Burlington, NC (US); Harry R. Byrd, Jr., Jamestown, NC (US); Allen J. Hawks, Mebane, NC (US)

(73) Assignee: Glen Raven, Inc., Glen Raven, NC (US)

( * ) Notice: Subject to any disclaimer, the term of this patent is extended or adjusted under 35 U.S.C. 154(b) by 285 days.

(21) Appl. No.: 09/851,888

(22) Filed: May 9, 2001

(65) Prior Publication Data

US 2002/0168908 A1 Nov. 14, 2002

(51) Int. Cl.[7] ..... B32B 27/02

(52) U.S. Cl. ..... 442/167; 442/130; 442/164; 428/920; 428/921; 427/157

(58) Field of Search ..... 442/130, 167, 442/164; 428/920, 921; 427/157

(56) References Cited

U.S. PATENT DOCUMENTS

| | | | | | |
|---|---|---|---|---|---|
| 3,670,068 | A | * | 6/1972 | Jones et al. | 264/182 |
| 3,729,920 | A | * | 5/1973 | Sayers et al. | 57/227 |
| 3,806,959 | A | | 4/1974 | Gross | 5/334 R |
| 3,925,016 | A | * | 12/1975 | Haase | 8/580 |
| 4,001,477 | A | | 1/1977 | Economy et al. | 428/224 |
| 4,035,542 | A | | 7/1977 | Rosenthal et al. | 428/224 |
| 4,084,027 | A | | 4/1978 | Berni et al. | 427/390 D |
| 4,151,322 | A | | 4/1979 | Rosenthal et al. | 428/254 |
| 4,167,603 | A | | 9/1979 | Sistrunk | 428/260 |
| 4,266,940 | A | * | 5/1981 | Blackburn et al. | 8/538 |
| 4,336,028 | A | * | 6/1982 | Tomibe et al. | 8/624 |
| 4,348,306 | A | | 9/1982 | Mischutin | 252/608 |
| 4,443,493 | A | | 4/1984 | Poisson | 34/116 |
| 4,732,804 | A | | 3/1988 | Kujas | 428/229 |
| 4,970,105 | A | | 11/1990 | Smith, Jr. | 428/198 |
| 5,033,262 | A | * | 7/1991 | Montgomery et al. | 57/5 |
| 5,114,786 | A | | 5/1992 | Louis | 428/270 |
| 5,180,793 | A | | 1/1993 | Vigneault et al. | 525/446 |
| 5,323,815 | A | | 6/1994 | Barbeau et al. | 139/420 A |
| 5,348,796 | A | | 9/1994 | Ichibori et al. | 428/224 |
| 5,397,509 | A | | 3/1995 | Kostrzecha | 252/607 |
| 5,448,779 | A | | 9/1995 | Aldridge | 2/326 |
| 5,478,154 | A | | 12/1995 | Pappas et al. | 383/117 |
| 5,486,412 | A | | 1/1996 | Weinrotter et al. | 428/288 |
| 5,496,623 | A | | 3/1996 | Fox | 428/224 |
| 5,503,915 | A | | 4/1996 | Ichibori et al. | 428/224 |
| 5,503,916 | A | | 4/1996 | Ichibori et al. | 428/224 |
| 5,506,042 | A | | 4/1996 | Ichibori et al. | 428/224 |
| 5,688,429 | A | | 11/1997 | Zakikhani et al. | 252/8.61 |
| 5,728,448 | A | | 3/1998 | Okeya et al. | 428/193 |
| 5,855,623 | A | * | 1/1999 | English et al. | 8/115.56 |
| 5,948,148 | A | | 9/1999 | Cuevas B. | 106/18.13 |

OTHER PUBLICATIONS

Pages of brochure for Westex Inc., believed to be prior art, date unknown.

Website printout for Head Lites Corporation, believed to be prior art, date unknown.

* cited by examiner

*Primary Examiner*—Elizabeth M. Cole
*Assistant Examiner*—Norca L. Torres
(74) *Attorney, Agent, or Firm*—Womble Carlyle Sandridge & Rice, PLLC

(57) ABSTRACT

A fabric for use in safety apparel and items of apparel formed substantially from modacrylic yarns and a cationic dye applied to the fabric so that the dyed fabric meets both the American National Standards Institute guidelines for high-visibility safety apparel and the guidelines of the American Society for Testing and Materials for flame resistant textiles.

16 Claims, No Drawings

FLAME-RESISTANT AND HIGH VISIBILITY FABRIC AND APPAREL FORMED THEREFROM

FIELD OF THE INVENTION

The present invention relates generally to fabric and safety apparel formed therefrom, and more particularly to fabric and apparel that meets nationally-recognized standards for both flame-resistance and high-visibility.

BACKGROUND OF THE INVENTION

Authorities worldwide have recognized the need to protect occupational workers from the inherent hazards of apparel that is deficient in contrast and visibility when worn by workers exposed to the hazards of low visibility. These hazards are further intensified by the often complex backgrounds found in many occupations such as traffic control, construction, equipment operation, and roadway maintenance. Of major concern is ensuring that these workers are recognized by motor vehicle drivers in sufficient time for the drivers to slow-down or take other preventive action to avoid hazard or injury to the workers. Thus, worker safety is jeopardized when clothing not designed to provide visual identification is worn by persons working in such dangerous environments. While there are no federal regulations governing the design, performance, or use of high-visibility apparel, local jurisdictions and private entities have undertaken to equip their employees with highly luminescent vests. One national standards organization, known as the American National Standards Institute (ANSI), in conjunction with the Safety Equipment Association (ISEA), has developed a standard and guidelines for high-visibility luminescent safety apparel based on classes of apparel.

Similarly, and in related fashion, certain of the above-mentioned occupations also require safety apparel that is flame resistant. For example, electric utility workers who may be exposed to flammable situations or to momentary electrical arc require apparel that is flame and/or arc resistant. In the United States, there is a nationally-recognized standard providing a performance specification for flame resistant textile materials for safety apparel, referred to as the American Society for Testing and Materials (ASTM), standard F 1506. This standard provides performance properties for textile materials used in apparel that represent minimum requirements for worker protection.

While various items of safety apparel have been produced to meet one or the other of these two nationally-recognized standards, at the date of this invention none are known in the prior art that are capable of meeting both standards for flame-resistance and high-visibility. For instance, there are a variety of natural and synthetic materials that are receptive to high-visibility dyestuffs, such as polyester and acrylic, but none of these untreated materials will withstand the burn test to meet the ASTM standard for flame resistance. In short, these materials melt when subjected to an open flame. Likewise, synthetic materials such as the aramids, have inherent flame resistance properties, but are not capable of being dyed in the international fluorescent colors. As of the date of this invention, no fabric or apparel has been developed that will satisfy both of the above standards for flame-resistance and high-visibility.

SUMMARY OF THE INVENTION

The present invention is directed to a fabric, and apparel formed therefrom, that meets the minimum guidelines laid out in ANSI/ISEA-107-1999, "American National Standard for High-Visibility Safety Apparel", and the vertical flame test of ASTM F 1506, "Standard Performance Specification for Flame Resistant Textile Materials for Wearing Apparel for Use by Electrical Workers Exposed to Momentary Electric Arc and Related Thermal Hazards".

ANSI/ISEA-107-1999 specifies requirements for apparel capable of signaling the wearer's presence visually and intended to provide conspicuity of the wearer in hazardous situations under any light conditions by day and under illumination by vehicle headlights in the dark. As used herein, and as defined in ANSI/ISEA-107, "conspicuity" refers to the characteristics of an object which determine the likelihood that it will come to the attention of an observer, especially in a complex environment which has competing foreground and background objects. Conspicuity is enhanced by high contrast between the clothing and the background against which it is seen. The ANSI standard specifies performance requirements for color, luminance, and reflective area. Three different colors for background and combined performance are defined in the standard. The color selected should provide the maximum contrast with the anticipated background for use of the apparel. Several combinations are described in the standard depending upon the intended use. For example, the ANSI standard describes three classes of conspicuity. For utility workers, the apparel would meet either Class 2 or Class 3 (Appendix B of ANSI 107-1999).

ASTM F 1506 provides a performance specification that may be used to evaluate the properties of fabrics or materials in response to heat and flame under controlled laboratory conditions. The properties of material for basic protection level wearing apparel should conform to the minimum requirements for woven or knitted fabrics with respect to breaking load, tear resistance, seam slippage, colorfastness, flammability before and after laundering, and arc testing. ASTM F 1506 specifies these performance characteristics based on fabric weight ranges, expressed in ounces per square yard.

The rigorous performance specifications of both of the above standards are met by the fabric and safety apparel of the present invention. One aspect of the present invention is directed to fabric formed substantially from modacrylic yams. Modacrylic yams are composed of less than 85 percent, but at least 35 percent by weight of acrylonitrile units. Modacrylic yarns have two characteristics that solve the problems addressed by the present invention. First, modacrylic yams are inherently flame resistant, with the level of flame resistance varying based upon the weight percentage of acrylonitriles in the composition. Secondly, modacrylic yams are very receptive to cationic dyes, which are known for their brilliance.

While ASTM F 1506 specifies minimum acceptance criteria in several categories, simply stated, the fabric and apparel will not melt or drip when subjected to the vertical flame burn test. Further, garments formed from the fabric of the present invention will not continue to burn after exposure to and removal from a source of ignition.

In an exemplary embodiment, fabric constructed according to the present invention is formed substantially from fire resistant modacrylic yarn that is spun in accordance with conventionally known techniques. It has been found that fabrics formed from modacrylic yarns wherein the fibers used to form the yams have at least about 35 percent by weight of acrylonitrile units provide a flame-resistance rating that meets at least the vertical flame burn test minimum criteria for safety apparel. The fabric may be either woven or knit. The inherently flame resistant material is dyed in conventional fashion in a jet dye machine with cationic, or basic, dyestuff compositions to obtain International Yellow or International Orange hues that will meet the luminescence and chromacity requirements of ANSI/ISEA-107-1999. While basic, or cationic, dyes are known for their acceptability on modacrylics, it has been heretofore unknown to apply such dyestuffs in the international colors to flame-resistant modacrylics to obtain shades and luminescence satisfactory for safety apparel.

These and other aspects of the present invention will become apparent to those skilled in the art after a reading of the following description of the preferred embodiment.

DESCRIPTION OF THE PREFERRED EMBODIMENT

While all modacrylics have a flame-resistant character to some extent, it has been found that fabrics formed from modacrylic yarns having at least about 35 percent by weight of acrylonitrile units will provide flame resistance that will meet the minimum standards of ASTM F 1506. That is, they will not melt and drip or continue to burn when a source of ignition is removed. Similarly, the number of acrylonitrile units should be less than about 85 weight percent. Preferably, the modacrylic fibers have about 50 percent acrylonitrile. Although other modacrylic fibers could be used to form the yarn and fabric of the present invention, the yam and fabric of the present invention as formed from short staple fibers of Kanecaron® SYS. Kanecaron® SYS is a 1.7 denier, 2 inch modacrylic fiber manufactured by Kaneka Corporation, Osaka, Japan. Kanecaron® SYS fiber has a tenacity of about 3 grams/denier, a Young's Modulus of about 270 kg/mm$^2$, and a dull luster and has been found to meet the structural requirements of both ANSI/ISEA-107-1999 and ASTM F 1506.

EXAMPLE

As is conventional in short staple yam manufacture, bales of such short staple fibers are initially subjected to an opening process whereby the compacted fibers are "pulled" or "plucked" in preparation for carding. Opening serves to promote cleaning and blending of fibers during the yam formation process. Those skilled in the art will appreciate that there are a number of conventional hoppers and fine openers that are acceptable for this process. The open and blended fibers are next carded using Marzoli CX300 Cards to form card slivers. The card slivers are transformed into drawing slivers through a drawing process utilizing a process known as breaker drawing on a Rieter SB951 Drawframe and finisher drawing on a Rieter RSB951 Drawframe. Drawn slivers are next subjected to a Roving process conventionally known in preparation for Ring Spinning. A Saco-Lowell Rovematic Roving Frame with Suessen Drafting is used to twist, lay and wind the sliver into roving. A Marzoli NSF2/L Spinning Frame is used to ring spun the yarn product. Winding, doubling, and twisting processes conventionally known in the art are used in completing the yarn product. A finished yarn found structurally suitable for the present invention is an 18 singles, 2-ply construction.

The illustrated fabric is woven; however, other constructions, such as knitted, and non-woven constructions may be used, provided they meet the design and structural requirements of the two standards.

The exemplary fabric is woven on a Dornier Rapier loom with 46 warp ends and 34 fill ends of yarn per inch and an off-loom width of 68 inches. The usable width of this fabric is approximately 60 inches. Any looms capable of weaving modacrylic yarns may just as suitably be used. The woven fabric has a desired weight of approximately 4 to 20 ounces per square yard, and desirably about 7.5 ounces per square yard as necessary to satisfy the design requirements for the particular class of safety apparel.

In preparation for dyeing, the woven fabric is subjected to desizing and scouring to remove impurities and sizes such as polyacrylic acid. The process of desizing is well known in the art. A non-ionic agent is applied in a bath at between about 0.2 and 0.5 weight percent of the fabric and an oxidation desizing agent is applied in a bath at about 2 to 3 percent of fabric weight. The use of such agents is well known in the art. The processing, or run, time for desizing and scouring is approximately 15 to 20 minutes at 60° C. The fabric is then rinsed with water at a temperature of 60° C.

The pretreated fabric is then ready for dyeing and finishing. The dyeing is formed in a jet dye machine such as a Model Mark IV manufactured by Gaston County Machine Company of Stanley, N.C. The specific dyes used to color the fabric of the present invention are basic, or cationic, dyestuffs. The cationic dyes are known for their acceptability in dyeing polyesters, nylons, acrylics, and modacrylics. However, it has heretofor not been known that these dyes could be formulated to dye modacrylic material in order to meet the luminance and chromacity criteria for safety apparel according to ANSI/ISEA-107 and the fire resistant criteria of ASTM F 1506. Two dye formulations have been found to meet the high visibility criteria for ANSI/ISEA-107. A dye formulation for International Yellow comprises basic Flavine Yellow, available from Dundee Color of Shelby, N.C. as color number 10GFF. It has been found that this dyestuff applied at between about 2 to 2½ percent of fabric weight successfully achieves the ANSI criteria. A dye formulation for International Orange may be formed from Blue and Red cationic dyestuffs, available from Yorkshire America in Rock Hill, S.C., as color numbers Sevron Blue 5GMF and Sevron Brilliant Red4 G and applied at percentages sufficient to meet the ANSI/ISEA-107 shade requirements.

Either of the dyestuffs described above are added to the jet dye machine. The Ph of the bath is established at between about 3 and 4, with acid used to adjust the Ph as required. The bath temperature in the jet dyer is raised at about 1° C. per minute to a temperature of about 80° C., where the temperature is held for approximately 10 minutes. The temperature is then raised approximately 0.5° C. per minute to a temperature of 98° C. and held for approximately 60 minutes. The bath is then cooled at about 2° C. per minute to 60° C. At that point, the bath is emptied and rinsing with water at 60° C. occurs until the dye stuff residue in the jet dyer is removed. At this point, the dyeing cycle is complete. Wet fabric is removed from the dye machine where it is dried on a standard propane open width tenter frame running at approximately 40 yards per minute at approximately 280° F. to stabilize width and shrinkage performance. At the completion of this process, a fabric that meets both the ANSI standard for high visibility safety apparel and the ASTM standard for flame resistance has been formed.

The finished fabric may be used to construct an unlimited number of types of safety apparel. The most common types are shirts or vests, and trousers or coveralls. The final constructed garments are designed and formed to meet the design, structural, and fastening criteria of the ANSI and ASTM standards.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric for use in safety apparel comprising:

(a) yarns consisting of strands of a modacrylic material; and (b) a dye applied to said fabric; and (c) wherein said dyed fabric meets both the American National Standard Institute standard ANSI/ISEA-107 minimum conspicuity requirements for occupational activities for high-visibility safety apparel and the American Society for Testing and Materials standard ASTM F-1506 for flame resistance.

2. The fabric of claim 1 wherein said fabric is woven.

3. The fabric of claim 2 wherein said modacrylic material contains at least 50 percent acrylonitrile.

4. The fabric of claim 2 wherein said woven fabric has a tensile strength of at least about 100 pounds in the warp direction and at least about 100 pounds in the weft direction.

5. The fabric of claim 2 wherein said woven fabric has a tear resistance of at least about 1360 grams.

6. The fabric of claim 1 wherein said fabric is knitted.

7. The fabric of claim 6 wherein said modacrylic material contains at least 50 percent acrylonitrile.

8. The fabric of claim 6 wherein said knitted fabric has a bursting strength of at least about 60 pounds.

9. A safety garment having high visibility and flame resistant characteristics formed substantially from a fabric comprising:

(a) yarns consisting of strands of a modacrylic material; and (b) a dye applied to said fabric; and (c) wherein said dyed fabric meets both the American National Standard Institute standard ANSI/ISEA-107 minimum conspicuity requirements for occupational activities for high-visibility safety apparel and the American Society for Testing and Materials standard ASTM F-1506 for flame resistance.

10. The safety garment of claim 9 wherein said fabric is woven.

11. The safety garment of claim 10 wherein said woven fabric has a tensile strength of at least about 100 pounds in the warp direction and at least about 100 pounds in the weft direction.

12. The safety garment of claim 10 wherein said woven fabric has a tear resistance of at least about 1360 grams.

13. The safety garment of claim 9 wherein said fabric is knitted.

14. The safety garment of claim 13 wherein said knitted fabric has a bursting strength of at least about 60 pounds.

15. The fabric of claim 1 wherein the dye is a cationic dye.

16. The safety garment of claim 9 wherein the dye is a cationic dye.

* * * * *